US006870508B1

(12) United States Patent
Rivera

(10) Patent No.: US 6,870,508 B1
(45) Date of Patent: Mar. 22, 2005

(54) ANTENNA FOR DEPLOYMENT FROM UNDERWATER LOCATION

(75) Inventor: David F. Rivera, Westerly, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/463,907

(22) Filed: Jun. 16, 2003

(51) Int. Cl.[7] ..... H01Q 1/34; H01Q 13/10
(52) U.S. Cl. ..... 343/709; 343/767
(58) Field of Search ..... 343/709, 767, 343/770, 792.5, 880, 915; 342/10

(56) References Cited

U.S. PATENT DOCUMENTS 2,067,337 A 1/1937 Polatzek
2,818,562 A 12/1957 Carter
3,210,767 A * 10/1965 Isbell ..... 343/792.5
3,626,418 A 12/1971 Berryman, Jr.
3,788,255 A 1/1974 Tennyson
3,972,047 A 7/1976 Lombardi
3,999,185 A 12/1976 Polgar, Jr.
5,132,696 A 7/1992 Cobb
5,790,082 A * 8/1998 Podger ..... 343/792.5
5,933,117 A 8/1999 Gerhard

* cited by examiner

*Primary Examiner*—Michael C. Wimer
(74) *Attorney, Agent, or Firm*—James M. Kasischke; Jean-Paul A. Nasser; Michael F. Oglo

(57) ABSTRACT

A slotted antenna comprises a plurality of loop structures and interconnecting conductors that define a slot. The antennas can operate in a single band or over multiple bands. Flexible or inflatable substrates enable easy storage aboard an underwater craft and facilitate deployment and towing behind an underwater craft with minimal chances of detection.

18 Claims, 15 Drawing Sheets

ANTENNA FOR DEPLOYMENT FROM UNDERWATER LOCATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to antennas and more specifically to an antenna that covers a wide frequency band and that can be deployed from an underwater location, such as from a submarine.

(2) Description of the Prior Art

As known, communications between the outside the world and underwater craft, such as a submerged submarine, can be achieved through a floating cable antenna system. With the advent of satellite communications, such antenna systems enable a submarine to remain submerged while communicating with other facilities throughout the world by means of satellite communications in the UHF and other frequency bands.

More specifically, such underwater craft deploy an antenna to the surface to establish communications while the craft remains submerged. After communications are completed, the antenna is reeled back into a storage area. Consequently, the presence of the antenna at the sea surface is minimized to reduce the possibility of detection. Specifically, the antenna as a physical radar contact is detectable only during its presence on the surface.

As an example, U.S. Letters Patent No. 2,067,337 granted in 1933 to Polatzek discloses a flexible tube or hose for deploying an antenna from a submarine. The hose is inflated with air under compression to overcome any loading on an aerial wire in the hose.

U.S. Letters Patent No. 3,788,255 granted in 1974 to Tennyson discloses an expendable submarine receiving antenna. A buoyant capsule has an opening therethrough for release from an ejection chamber in a submarine. The capsule contains a coil of lead-in wire with electrical insulation suitable for use in seawater and having a length that extends between the submerged submarine and the surface. A free end of the wire extends freely through the opening in the capsule for withdrawal and severance of a selected length of the wire for connection at the free end to radio communication equipment aboard the submarine.

U.S. Letters Pat. No. 3,972,047 granted in 1976 to Lombardi for a floating cable antenna system discloses an antenna system in which a submerged submarine tows a buoy by means of an electromechanical cable. A cable reel stores the inflatable buoyant cable and has a pressure accumulator containing a medium under given pressure attached to one end of the buoyant cable. Slip rings provide a communication with the electromechanical cable radio communications.

U.S. Letters Pat. No. 5,132,696 granted in 1992 to Cobb discloses a pneumatic extendable antenna for a water deployable buoy. A whip antenna extends from a shortened configuration to a lengthened configuration. The antenna body comprises a plurality of hollow frusto-conical segments that slidably nest inside each other when the antenna is in its shortened or compact configuration. Filling the container with a pressurizing gas expands the segments relative to each other. A weighted ballast and electronic control circuit attached to one end of the antenna and an air filled stability bag disposed about the antenna near its weighted end orients the antenna in a vertical direction.

U.S. Letters Pat. No. 5,933,117 granted in 1999 to Gehard discloses a flexible ferrite loaded loop antenna assembly. A buoyant loop antenna is deployed along a cable with a core region that comprises a plurality of annular ferrite beads. The ferrite beads are aligned with the concave end of one bead against the convex end of another bead so the cable can flex while the beads maintain contact with each other thereby providing flexibility and resistance to crushing. The core region has a looped wire wrapped helically around it forming the loop antenna. The looped wire elements start and end at the same end of the core region forming a loop. The loop allows reception in an athwart (side to side) direction. The wire loop antenna can be combined with a straight wire antenna to provide reception in a fore and aft direction thereby to provide an omni-directional cable antenna assembly.

Each of these references discloses an antenna that is relatively large and therefore readily detectable at the surface by modern radar systems. With the exception of the Gerhard patent with its complicated ferrite beads that provides some flexibility, the antennas are rigid and not adapted for wrapping on a reel. Many of them require external gas in order to inflate and rise to the surface. Further, each of them tends to be an end fed antenna with the exception of the Gerhard patent that discloses multiple antenna elements to obtain an omni-directional range. The Gerhard patent additionally is directed to VLF/LF transmission bands that incorporate entirely different signal requirements than the typical transmission frequencies in the 200–400 MHz band.

In addition to these antennas, other antennas have been proposed that provide radiation patterns that are more advantageous particularly with respect to satellite communications, but not readily adapted for deployment from underwater craft. For example, U.S. Letters Pat. No. 2,622,196 granted in 1952 to Alford discloses an ultra-high frequency antenna that generates horizontally polarized waves. The antenna comprises a number of small loops shunted across a balanced transmission line arranged so that a large number of loops may be cophasally energized thereby attaining a large concentration of radial power in a plane in which the radiation is distributed in a substantially circular pattern.

U.S. Letters Pat. No. 2,812,562 granted in 1957 to Carter discloses loop antennas for television signals with a loop antenna array of a plurality of loops coupled together by a section of transmission line that has a quarter wavelength, or any odd multiple thereof, at the frequency of operation and having field patterns superimposed in phase quadrature relationship. The loop is preferably a single turn arrangement having a circumference in the order of one or a few wavelengths at the operating frequency and made of a large diameter conductor.

U.S. Letters Pat. No. 3,626,418 granted in 1971 to Barryman discloses a VHF antenna comprising a plurality of closed loop radiating elements that are parallel fed by a tapered pair feed line. Each loop comprises a single turn of conductive material whose dimensions are uniform over the entire loop so each loop is electrically uniform and continuous. The loops are fed in parallel by uniformly tapered feed lines comprising two congruent strips of conductive material that diverge at a small angle. A first loop of said plurality of loops has a circumference equal to one half length at the lowest desired frequency. A second loop has a circumference equal one-half wavelength at the highest desired frequency. The remaining loops are of intermediate size between the first and second loops.

U.S. Letters Pat. No. 3,999,185 granted in 1976 to Polgar, Jr. et al. discloses plural antennas on a common support with feed line isolation. This structure includes a tunable high power MF/HF transmitting antenna having a vertical access and shorting assembly driven along a vertical axis to tune the high power antenna. A plurality of additional antennas are disposed in a vertically stacked relationship above the high power antenna. A tunable ferrite isolator is disposed below a drive shaft and includes a conduit that enables the conduit and the service conductors to pass through the high power antenna with a minimum modification to the performance of the high power antenna.

Of all these antennas, it has been found that the loop antenna, such as disclosed in U.S. Letters Pat. No. 2,622,196, has the potential for providing a desired radiation pattern to a number of applications. However, this structure is a rigid structure that also is not readily adapted for undersea applications. Specifically, it is difficult to store such a rigid structure and to provide any structure that would allow an antenna to rise to the surface.

SUMMARY OF THE INVENTION

Therefore it is an object of this invention to provide an improved antenna structure that can be deployed from underwater craft, such as submarines.

Another object of this invention is to provide an antenna structure that can be deployed by providing a low radar signature.

Still another object of this invention is to provide an antenna for underwater craft, such as submarines, that is readily stowed with its cable without special housings or storage containers.

Yet another object of this invention is to provide an antenna structure for use as a deployable antenna from a submarine that maintains an impedance match over a wide frequency band.

Yet still another object of this invention is to provide a deployable antenna for use with underwater craft, such as submarines that provides elliptically polarized signals.

Still yet another object of this invention is to provide an antenna structure that operates as a solid sheet metal slotted antenna.

In accordance with one aspect of this invention, an antenna that is deployable from an underwater housing comprises a support and a slotted antenna structure. The support extends along an antenna axis, and the antenna is flexible about radii transverse to the axis. The slotted antenna structure is formed on the flexible support with an axis coincident with the antenna axis and with a plurality of antenna loops extending along the antenna axis such that each antenna element is substantially transverse to the antenna axis.

In accordance with still another aspect of this invention, a deployable antenna for use in underwater craft includes a flexible support that has compact and expanded states. The flexible support carries an elongated antenna structure to be in operating condition in the expanded state. A gas contained within the flexible support provides appropriate expansion of the flexible support from its compact to its extended state as the antenna rises to the surface. A retainer device maintains the flexible support in its compact structure.

In accordance with another aspect of this invention, an antenna is provided that operates with the characteristics of a solid slot antenna. The antenna comprises a plurality of conductive loops spaced along and substantially transverse to an antenna axis. The loops are oriented in a substantially parallel relationship. Each loop has first and second spaced, facing end portions. A first conductor interconnects the first end portions, and a second conductor interconnects the second end portions. The first and second conductors are spaced and form a slot path.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
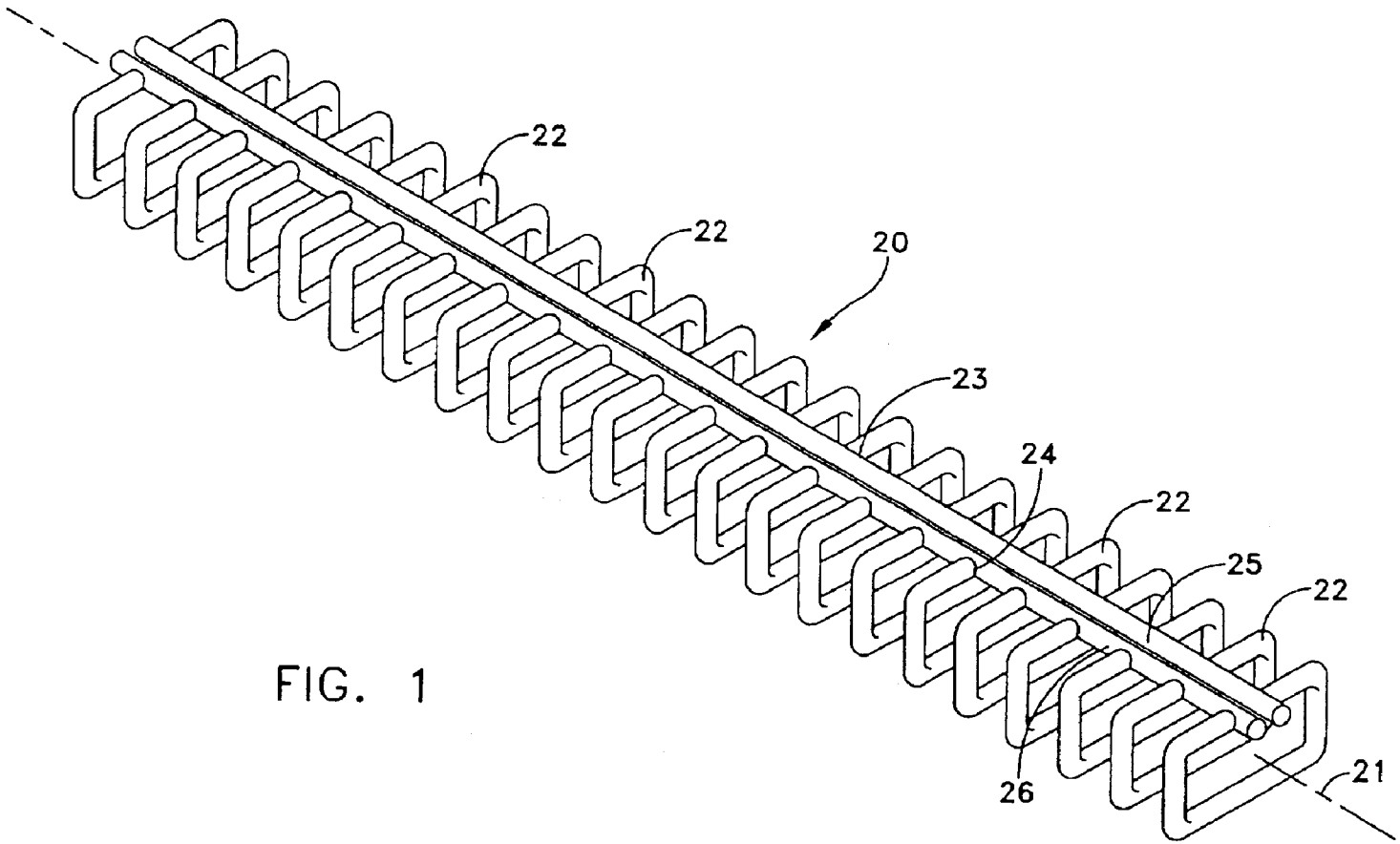
FIG. 1 is a perspective view of an antenna structure that is useful in this invention.

In FIG. 1 a basic slotted antenna structure 20 extends along an antenna axis 21 and comprises a series of metal loops 22 that lie in parallel planes transverse to the antenna axis 21. Each metal loop 22 is an open loop with counter-facing first and second ends 23 and 24 on each loop define an opening or slot. First and second spaced parallel conductors 25 and 26 interconnect the first and second ends 23 and 24, respectively. That is, the first conductor 25 attaches to all of the first ends 23 of each loop while the second conductor 26 attaches to all of the second ends 24 of each loop. In this particular embodiment, the conductors 25 and 26 are parallel and spaced to define the slot further. Ends of the parallel conductors 25 and 26 provide a means for attaching an RF communication system.

It is desirable that the number and spacing of the open loops 22 produce an antenna structure that emulates a slotted-cylindrical antenna made from sheet metal. The metrics for determining the usefulness of such an antenna include an analysis of the radiation, propagation and impedance properties in the slot region.

A useful radiation property is free spaced directivity that measures how the radiated energy is spatially concentrated around the antenna. Directivity for such an antenna structure can be approximated by:

$$D = \frac{3n^2}{2\left\{n + 6\sum_{m=1}^{n-1}(n-m)\left[\frac{\cos(mks)}{(mks)^3} - \frac{\sin(mks)}{(mks)^2}\right]\right\}} \quad (1)$$

Where n and s are the number of loops and spacing between the loops respectively, k is a free space-wave number that is $2\pi/\lambda$ and m is a summation index; basically the loop number, so that D is found by summing from loop 1 (m=1) to loom m=n−1 (n being the total number of loops). It has been observed that the plot with one thin loop provides an antenna directivity, D, with a value of 3/2. As the number of loops are increased without bound while constrained over a finite axial length, 1, the directivity increases but asymptotically approaches the directivity of the slotted sheet metal radiator of corresponding length. Consequently Equation (1) can be recast as Equation (2) where Si (X) is the sine integral defined as:

$$D = \frac{(kL)^2}{2\left[\cos(kL) + \frac{\sin(kL)}{kL} + kLSi(kL) - 2\right]} \quad (2)$$

This equation assumes that the ratio of the antenna perimeter, (p) to the wavelength ($\lambda$) is small. In a submarine application this perimeter-wavelength ratio is desirable since it yields a slender antenna that minimizes the potential for radar detection. Moreover, as will be described, this condition permits the antenna to have a toroidal pattern in which the pattern null is on the antenna axis.

A model with ten loops yields a directivity that is 8% above the final level value given by Equation (2). Doubling the number of loops yielded the directivity that was 4% above the final value. Thus, a given antenna length will have a combination of loop number, n, and spacing, s, such that the resulting directivity is approximately the limiting value described by Equation (2).

With respect to the propagation constant, the feed region of an antenna comprised of a parallel wire line has electrical properties that are similar to a solid cylindrical slotted antenna. More specifically a complex number $\gamma(=\alpha+j\beta)$ typically has a small value in the attenuation constant, $\alpha$, and an increase in the phase constant, $\beta$, in the band of interest. Below the band of interest, i.e., below 225 MHz in a typical submarine application, $\alpha$, increases and $\beta$ decreases. An intersection at the cutoff frequency below which wave propagation in the slot region is evanescent and the antenna behaves as a lossy transmission line. The values at cutoff, $\alpha_c$ and $\beta_c$, are related to a normalized cutoff wave number ($k_c a_e = p/\lambda_c$) by $$\alpha_c = \beta_c \approx \sqrt{\frac{5\pi}{2[5-(p/\lambda_c)]}\left[\frac{1+16(p/\lambda_c)^4}{1+10(p/\lambda_c)^4}\right]} \quad (3)$$

where p is the mean perimeter of the antenna cross section. It has been found that with a cutoff frequency of 220 MHz, an antenna can be constructed with a mean perimeter of 18.2 inches to yield $\alpha_c=\beta_c=1.10\ m^{-1}$. Lower values of $k_c\alpha_e$, may be obtained by increasing the perimeter, p, or decreasing the slot width. Analysis of both an antenna structure as shown in FIG. 1 and a solid structure demonstrate that the propagation constants are very similar with a slight displacement of the $\alpha$-$\beta$, intersection points. Given this, an antenna with twenty loops 22 is sufficient to simulate a solid radiator in the frequency range of 200–400 MHz.

With respect to impedance, it has been found that the feed point impedance at any arbitrary location along the parallel conductors 25 and 26 in FIG. 1 may be computed approximately by $$Z_{in} = Z_0\left[\frac{\coth(\gamma l_1)\coth(\gamma l_2)}{\coth(\gamma l_1)+\coth(\gamma l_2)}\right] \quad (4)$$

where $\gamma=\alpha+j\beta$, $1_1$ and $1_2$ are the distances from each end to the feed point, respectively, and $Z_0$ is the characteristic impedance of the slot region. When the feed point is positioned at the center such that $1_1=1_2$, Equation (4) reduces to $$Z_{in} = \frac{Z_0}{2}\coth(\gamma l) \quad (5)$$

where 1 is now the half-length of the antenna. This analysis indicates that the feed point resistances have reactances of a twenty-loop antenna structure 20 and the solid antennas are essentially similar with the values of $Z_0$ and $\gamma$ roughly equal.

Figure 2A:
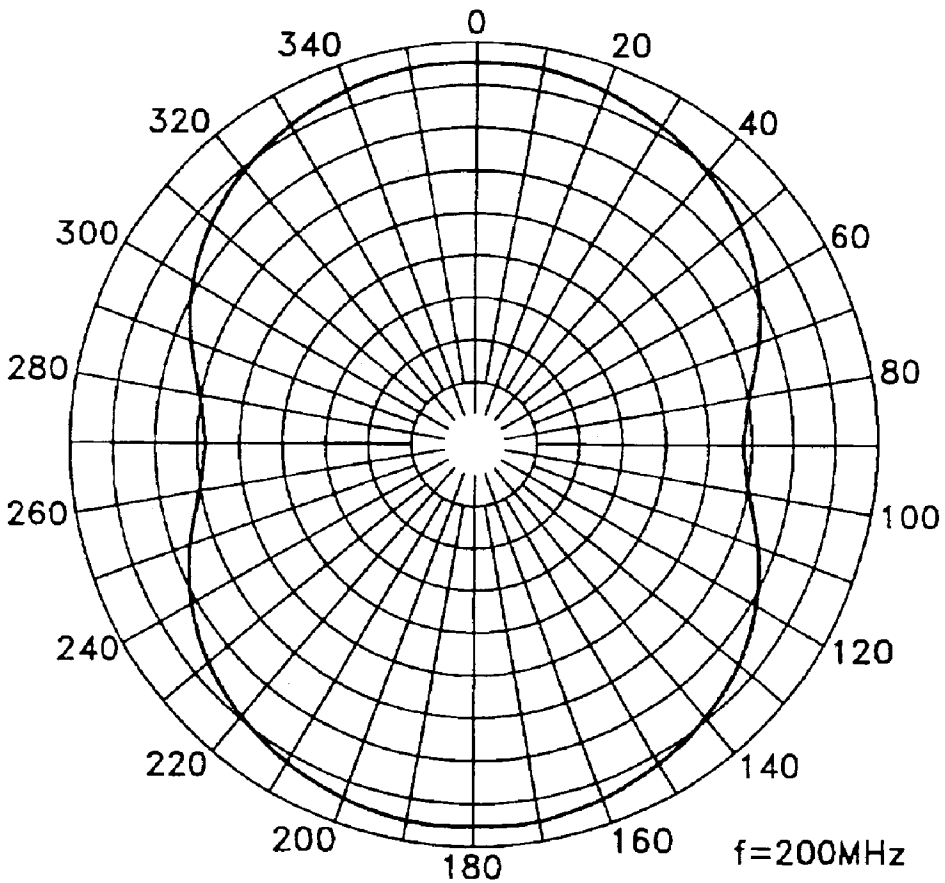
FIGS. 2A through 2E depict the radiation pattern for the antenna in FIG. 1 over defined frequency band.
Figure 2B:
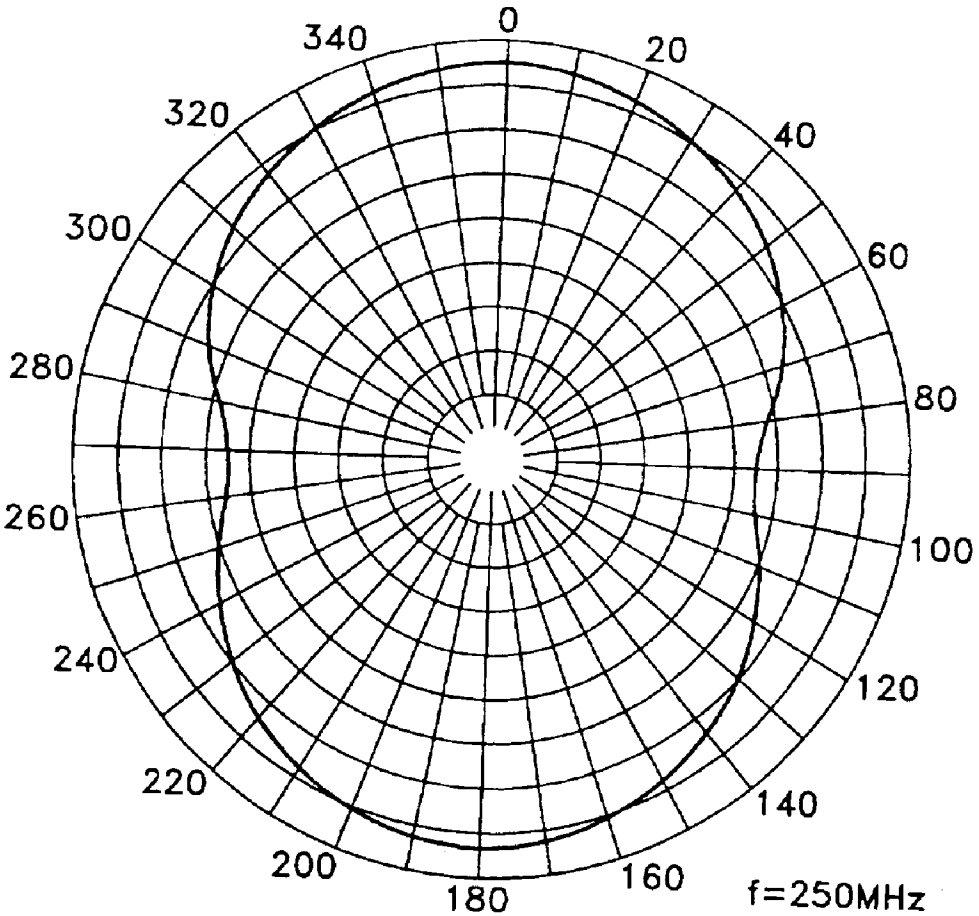
Figure 2C:
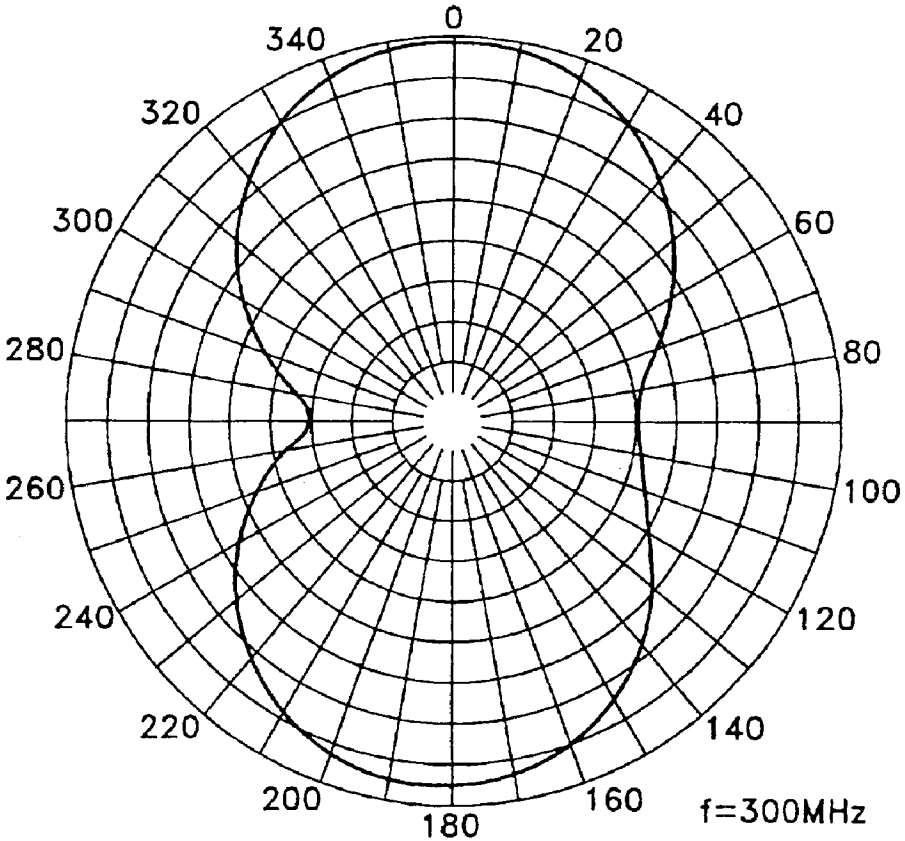
Figure 2D:
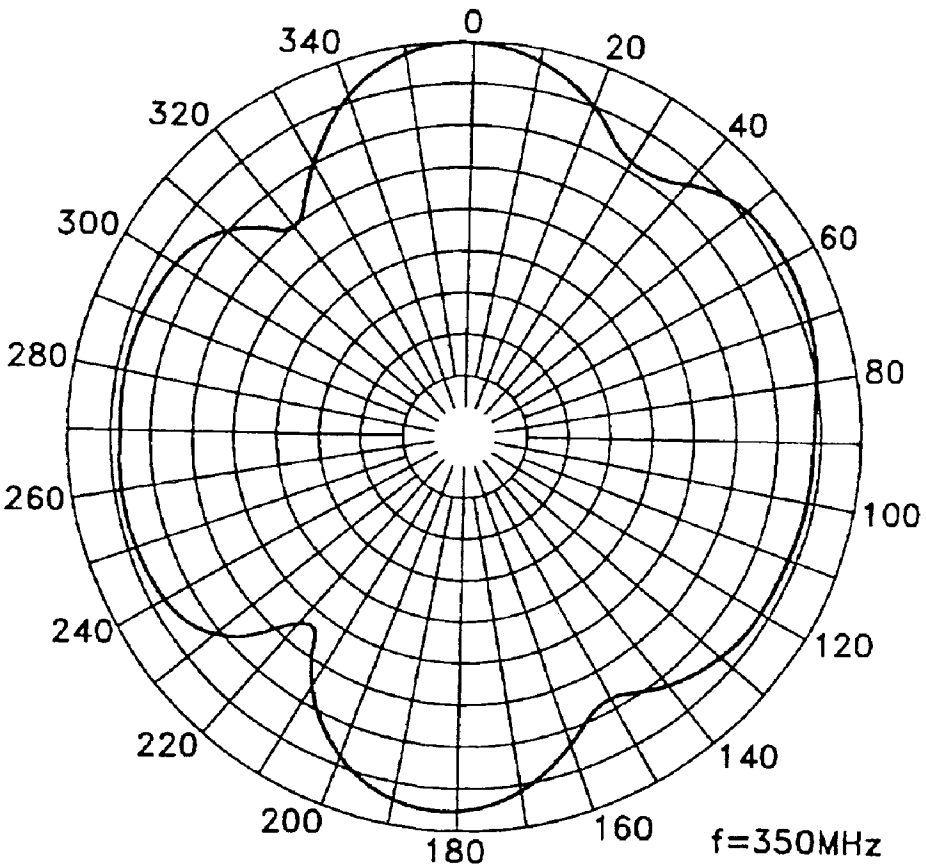
Figure 2E:
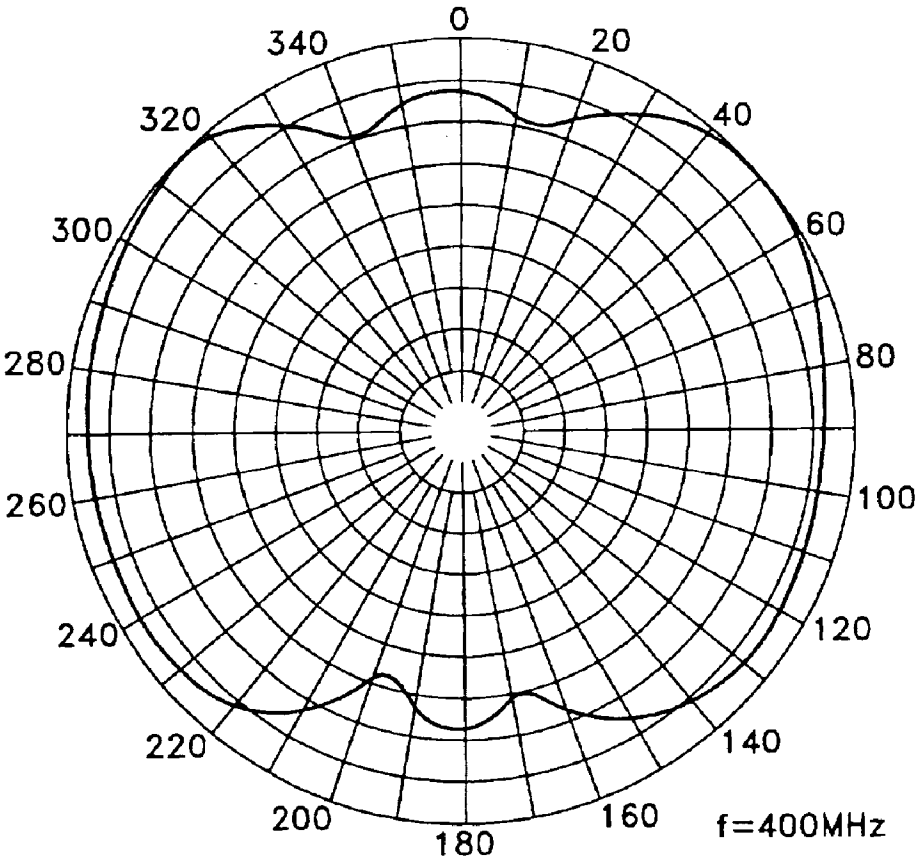

FIGS. 2A through 2B depict the radiation patterns from a twenty-loop antenna structure according to the foregoing designs at 200 MHz, 250 MHz, 300 MHz, 350 MZ and 400 MHz respectively. From this it can be seen the antenna is directional over the entire band.

Figure 3:
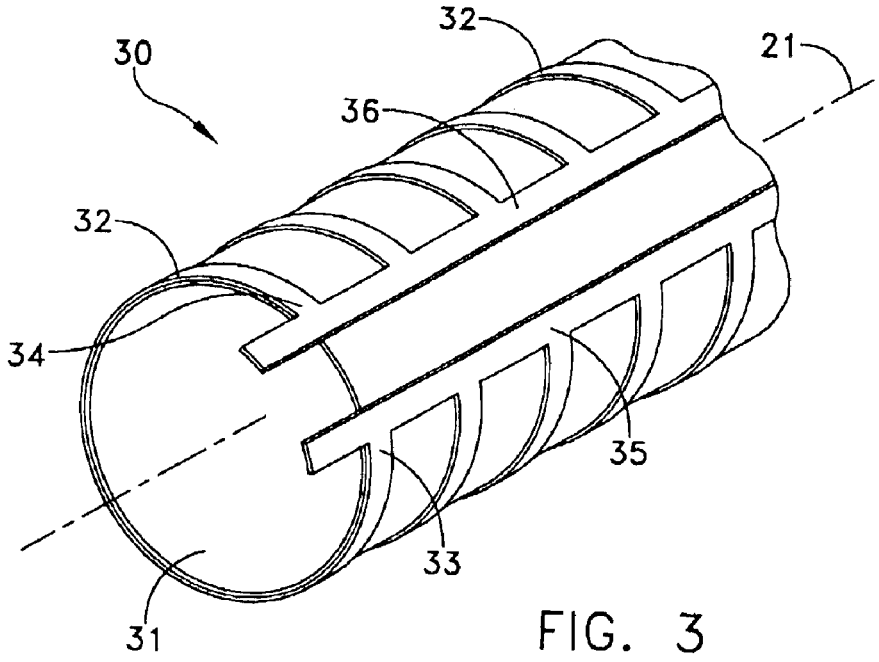
FIG. 3 is a perspective view of a portion of the antenna constructed in accordance with this invention with a support in an expanded state.
Figure 4:
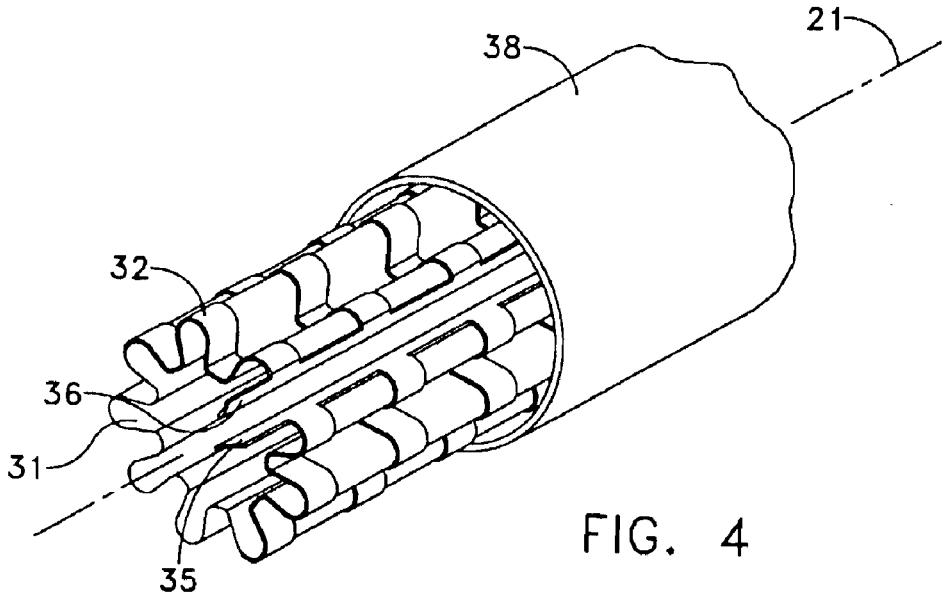
FIG. 4 is a perspective view of the antenna in FIG. 3 with its support in a compact state.

An antenna structure, such as the antenna structure 20 in FIG. 1, will have appropriate characteristics for towing at the water surface for high frequency communications in the 200 MHz through 400 MHz bandwidth. FIG. 3 depicts one embodiment of such a structure. Specifically, it includes a collapsible support 31 that extends along the antenna axis 21. FIG. 3 depicts the antenna in an expanded state in which the support, formed of an insulating material such as Mylar, has the antenna elements deposited thereon. More specifically, FIG. 3 depicts a plurality of loops 32 that extend between first ends, such as the first end 33 and second ends, such as the second end 34. An axially extending conductive path 35 on the substrate 30 spans the first ends 33; a conductive path 36, the second ends 34. The substrate 31 is formed of a flexible material. In a compact form the substrate 31 assumes a pleated or similar configuration carrying the deposited elements of the antenna structure including the loops 32 and the conductors 35 and 36 into the pleated or compacted configuration. FIG. 4 depicts a retaining sleeve 38 that can receive the compact antenna and retain it in position.

In a preferred embodiment of this invention the substrate 31 forms a sealed compartment that contains a small amount of gas, such that in its compact form the antenna structure 30 has some buoyancy even as it is transferred into the ocean at depth. As the buoyant antenna structure 30 rises to the surface, it expands. As will be apparent, the gas pressure in the expanded state exceeds the pressure that would lead to substrate failure.

Figure 5:
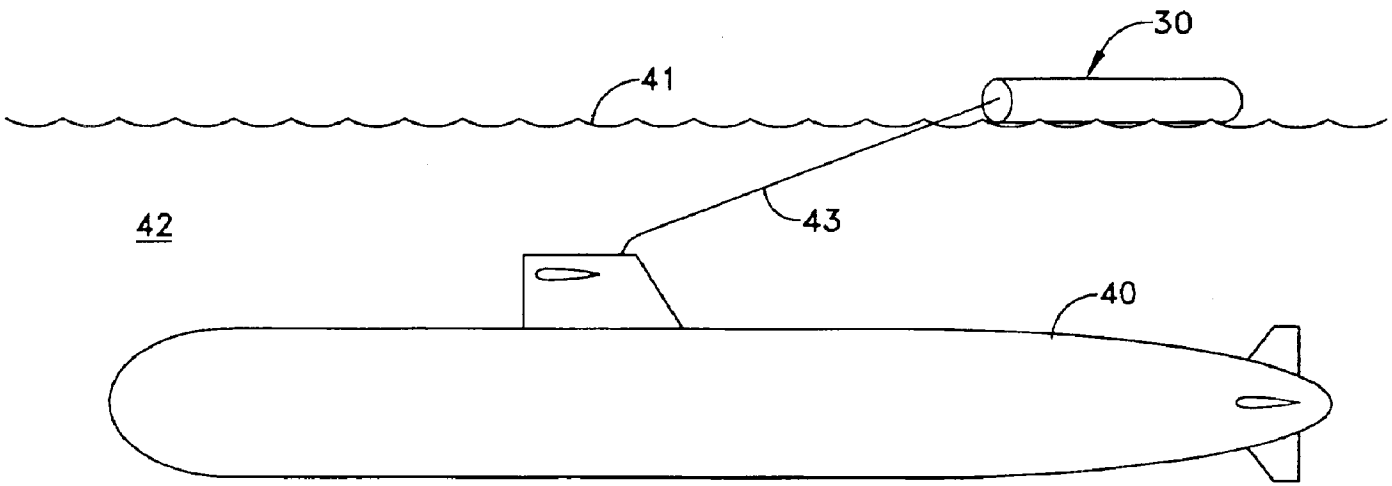
FIG. 5 depicts the deployment of the antenna from a submarine.

FIG. 5, that is not to scale, depicts a submarine 40 trailing the antenna structure 30 at the surface 41 of the water while the submarine remains in an undersea portion 42. A cable 43 tethers the antenna structure 30 to the submarine 40.

Figure 6:
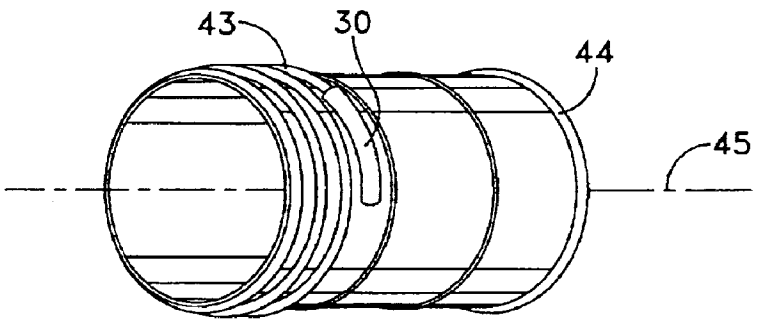
FIG. 6 depicts the storage position of the antenna on a drum in a submarine.

FIG. 6 depicts the antenna structure 30 and cable 43 in a stored position. In this specific example, a drum 44 rotates on an axis 45 to wrap the cable 43. When the antenna structure 30 reaches the drum, it will have been partially compressed by the water pressure at the exterior of the submarine 40. Then the retaining sleeve 38 can be placed in position to keep the antenna structure in the compact form shown in FIG. 4. One of the advantages of this invention will now become apparent. Specifically, the spacing of the loops 32 shown in FIG. 3 allows the antenna to have flexibility.

Thus, an antenna structure, such as the antenna structure 20 in FIG. 1, will have appropriate characteristics for an antenna to be towed at the water surface for high-frequency communications in the 200 MHz through 400 MHz bandwidth. FIG. 3 depicts on one embodiment of such a structure. More specifically, using metallic loops instead of a sheet metal surface as normally used in a slotted antenna provides spaces between the adjacent loops that serve as gaps. The gaps allow the antenna to bend with a certain radius. This feature allows the antenna to be stored on a reel or drum, such as the antenna 30 on the drum 44 in FIG. 6. Similarly, if the antenna conductors are embedded in an elastomer capable of stretching with applied gas pressure, the antenna could be made to inflate. This would allow alternate inflation and deflation would provide the expanded and compacted states of FIGS. 3 and 4 directly. This again is useful for stowage purposes.

The physical attributes of this antenna structure also facilitate its construction. For example, the antenna might be blow molded in a manner similar to that used for liquid containers. After molding, the exterior structure could be plated with a thin layer of metal to form the antenna. Thus, in a pattern such as the pattern shown in FIG. 3 or corresponding to any other patterns as more specifically described later. The interior of the support 31 shown in FIG. 3 can also be filled with a syntatic foam formulation to provide strength while maintaining light weight. Alternatively, the metallic structure can be imbedded into a rubbery material. If an antenna is made with an elastomeric material such as polyurethane, it can be fabricated as a bladder with air voids with the flexible conducting members comprising the antenna inserted between the bladder walls. In this arrangement, if the antenna assembly is deployed from the submerged ship toward the ocean surface, the decrease in hydrostatic pressure allows the antenna to assume its form for operation.

As known, the major advantage of a submarine is its stealth. Floating a transmitting antenna on the surface can provide a radar signature. It has been found, however, that an antenna constructed in accordance with this invention exhibits a significantly decreased radar signature over a corresponding slotted solid antenna.

When a solid slotted antenna is at the surface, a degree of capacitive coupling between the antenna structure and surrounding seawater ground plane can vary effective gain. In such environments gain is a function of angular rotation. An antenna constructed in accordance of this invention minimizes the effect of function because only a small portion of the antenna surface couples to the seawater at any given instant of time.

The combination of the foregoing attributes provides advantages over conventional submarine antennas. When an antenna according to this invention is deployed on the surface, reflections due to wave effects or sea clutter may be much larger in any radar image of the area. This has the potential of providing an antenna that is undetectable by radar. It is also expected that the cooling effect of the seawater wash over the antenna will tend to make any infrared signature indistinguishable.

Figures 7, 8:
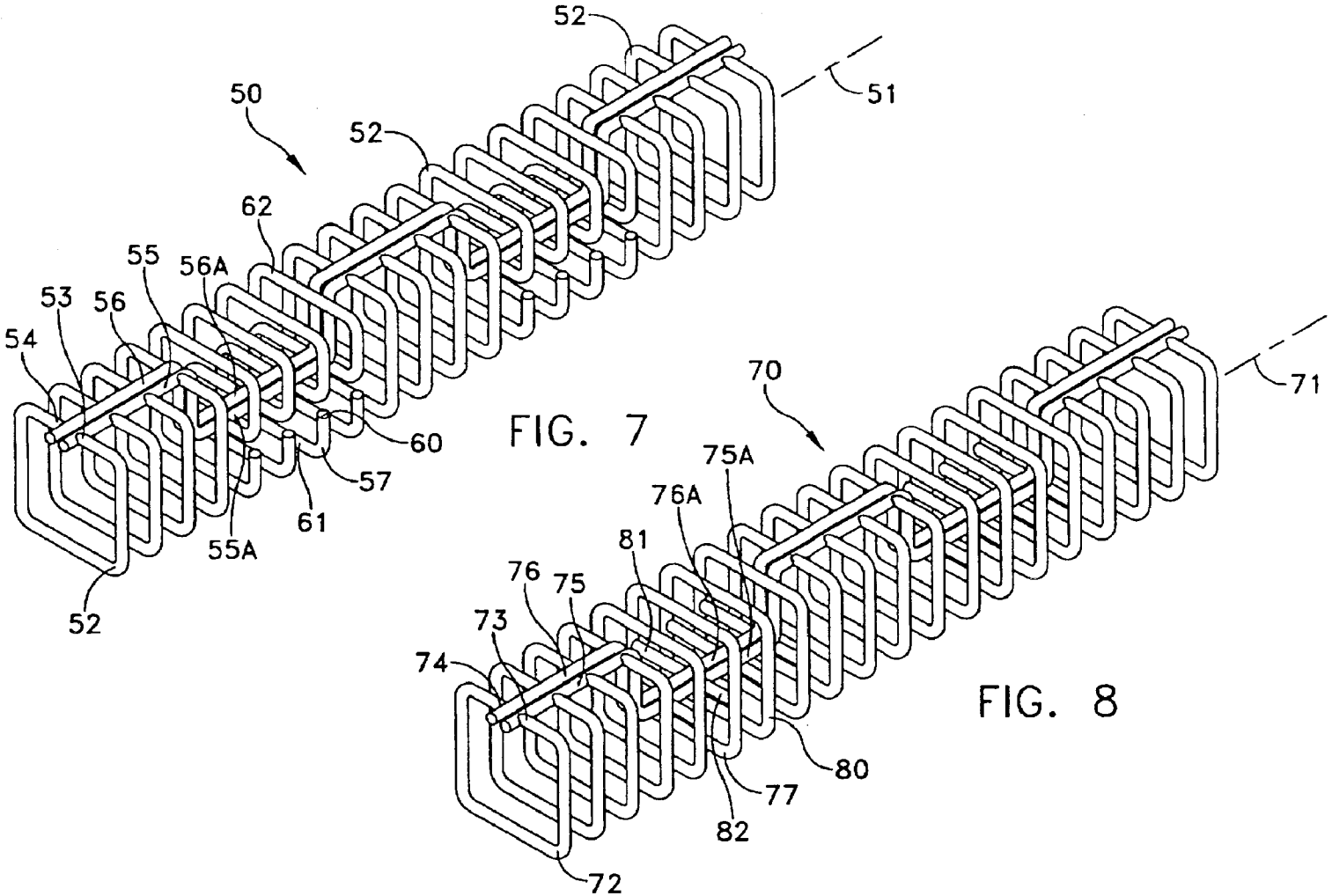
FIGS. 7 through 13 depict alternative embodiments of an antenna such as shown in FIG. 1.

The basic antenna structure shown in FIG. 1 can be modified to provide a number of different antenna embodiments that may be used as substitutes for the structure of FIG. 1 in an inflatable or flexible antenna or in a rigid antenna. For example, FIG. 7 depicts an antenna structure 50 that acts as a hybrid slot-dipole antenna extending along an antenna axis 51. The antenna structure 50 includes first loops 52 that are similar in a configuration as loops 22 in FIG. 1. Each loop 52 has a first end 53 and a second end 54. Space parallel conductors 55 and 56 interconnect with the first and second ends of the loops 52 respectively.

At other positions along the axis, the antenna 50 compresses loops 57 with an essentially reverse s-shape in the perspective of FIG. 7. Each such loop 57 terminates at a first free end 60 and a spaced second free end that is not visible in the perspective of FIG. 7. Each free end 60 is a portion of a lower loop element 61, and each loop 57 also includes an upper element 62. The loops 57 are split at the center to connect to portions 55A and 56A of the parallel conductors.

More specifically, the parallel conductors 55 and 56 meander by shifting radially from the outer position shown at their connection to loops like the loops 52 to the substantially axial position of portions 55A and 56A. Portions like the portion 55A drive each element 61; portions like the portion 55A drive each element 62. This radial meandering of the conductors 55 and 56 produces a structure that constitutes an array of dipoles. The vector addition of the fields radiated from the composite structure produces a beam with maximum lobes tilted 45° from broadside.

FIG. 8 depicts an antenna structure 70 extending along an axis 71 with loops 72 like the loops 22 in FIG. 1. Each loop 72 has a first end 73 and a second end 74. Spaced parallel conductors 75 and 76 attach to the first and second ends 73 and 74 respectively. The conductors 75 and 76 meander radially from the outer position shown at loops 72 to a substantially center or axial position along the axis 71 where they connect to a second set of loops 77. Each loop 77 has a closed outer loop 80 element. Additional elements from the mid-point of opposite sides such as elements 81 and 82, extend radially; that is they extend horizontally in the perspective of FIG. 8, to connect to the center portions 75A and 76A. The parallel conductors 75 and 76 therefore define a slot that meanders radially in the orientation of FIG. 8. Varying the pattern of the meander such as the number of undulations of the slot controls either impedance or pattern.

Figure 9:
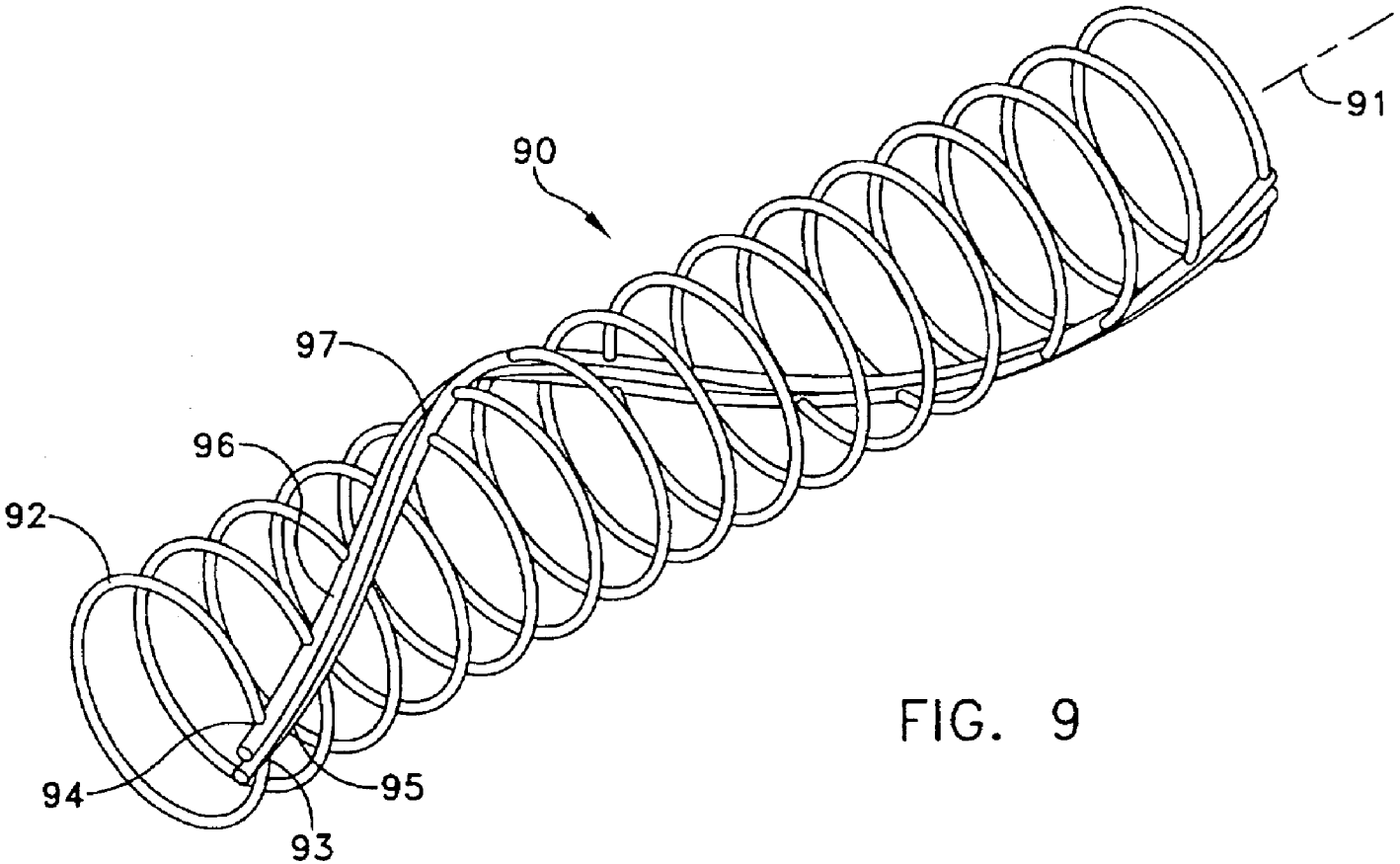

FIG. 9 depicts a circumferentially or helically meandering slot. Specifically, an antenna 90 extends along an antenna axis 91 with plurality of circular loops 92 that have end portions 93 and 94. Conductors 95 and 96 interconnect with the ends 93 and 94 respectively. In this particular embodiment the location of the ends varies circularly along the axis. Consequently, a slot 97 defined by the conductors 95 and 96 meanders circumferentially or helically relative to the axis 91. Like the antenna shown in FIG. 8, controlling the pitch of the meander provides impedance and pattern control.

Figure 10:
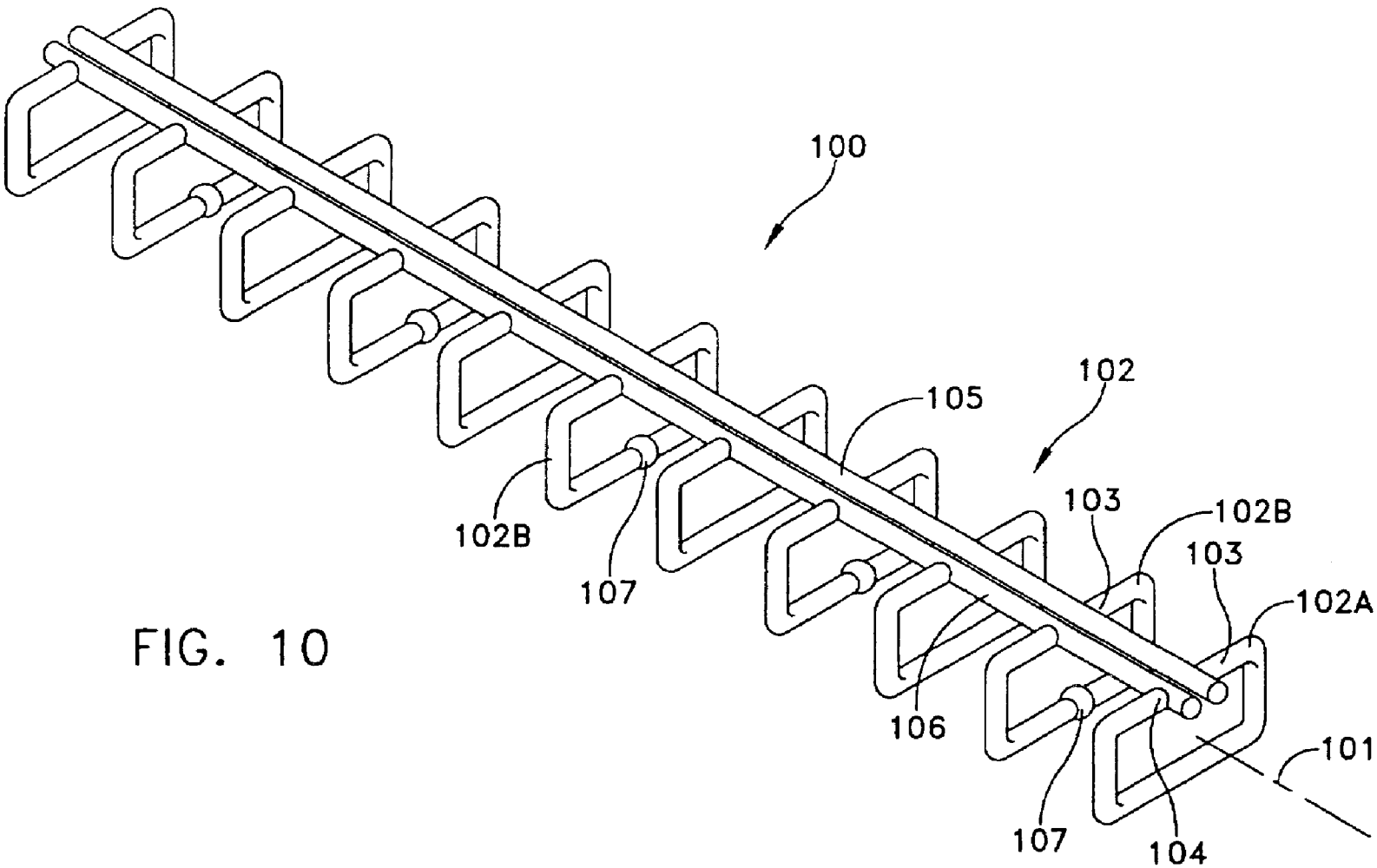

FIG. 10 depicts another embodiment in the form of an antenna 100 that extends along an axis 101. This antenna 100 comprises loops 102 characterized by having an opening at spaced ends 103 and 104. In this embodiment alternate loops are designated by references 102A and 102B. Spaced parallel conductors 105 and 106 interconnect the ends 103 and 104 respectively to form a slot. In this particular embodiment alternate loops, such as loops 102B, incorporate a PIN switch 107 opposite the slot. When all the PIN switches 107 are closed, the antenna 100 acts as a slot antenna such as shown in FIG. 1. When the PIN switches 107 are open, the antenna acts as a hybrid dipole-slot antenna and the beam tilts 45°. Alternate switching mechanisms can be substituted and the position of the switches can be altered for different phasing effects.

Figure 11:
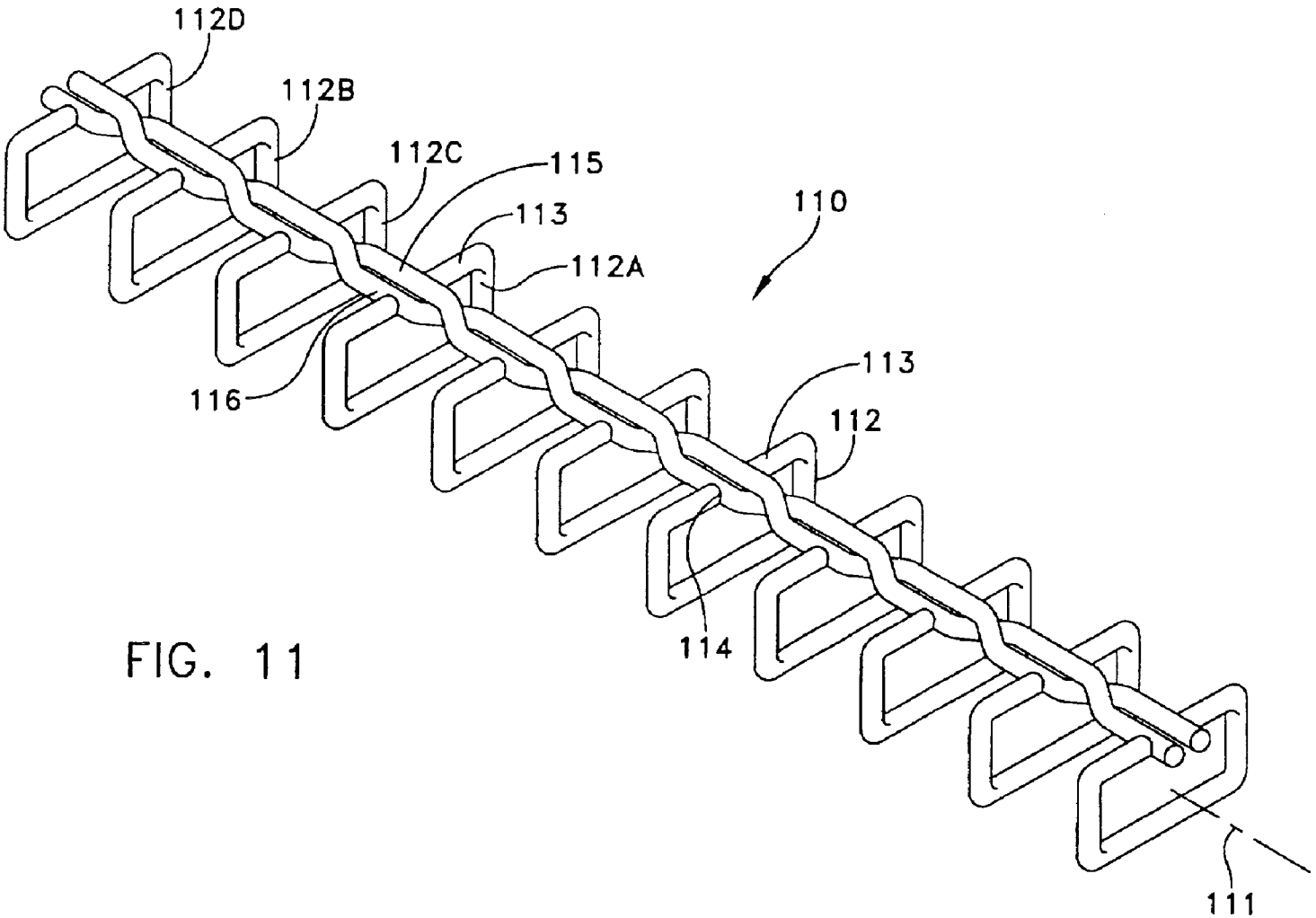

FIG. 11 depicts another embodiment of an antenna 110 that extends along an antenna axis 111. The antenna 110 comprises a plurality of spaced loops 112 having open ends 113 and 114. In this embodiment conductors 115 and 116, that form the slot, rotate about themselves to connect to the ends 113, and 114 in an alternating fashion. For example, the conductor 115 connects to each first end 113 of loops 112A and 112B, while the conductor 116 connects to each first end 113 of loops 112C and 112D. In FIG. 11 the twists are shown continuously. The twists can also be separated to produce an antenna with a twisted slot and a straight slot over axially displaced portions. Twisting the slot as shown in FIG. 11 results in a phase shift along the slot that can generate radiation patterns having different shapes.

Figure 12:
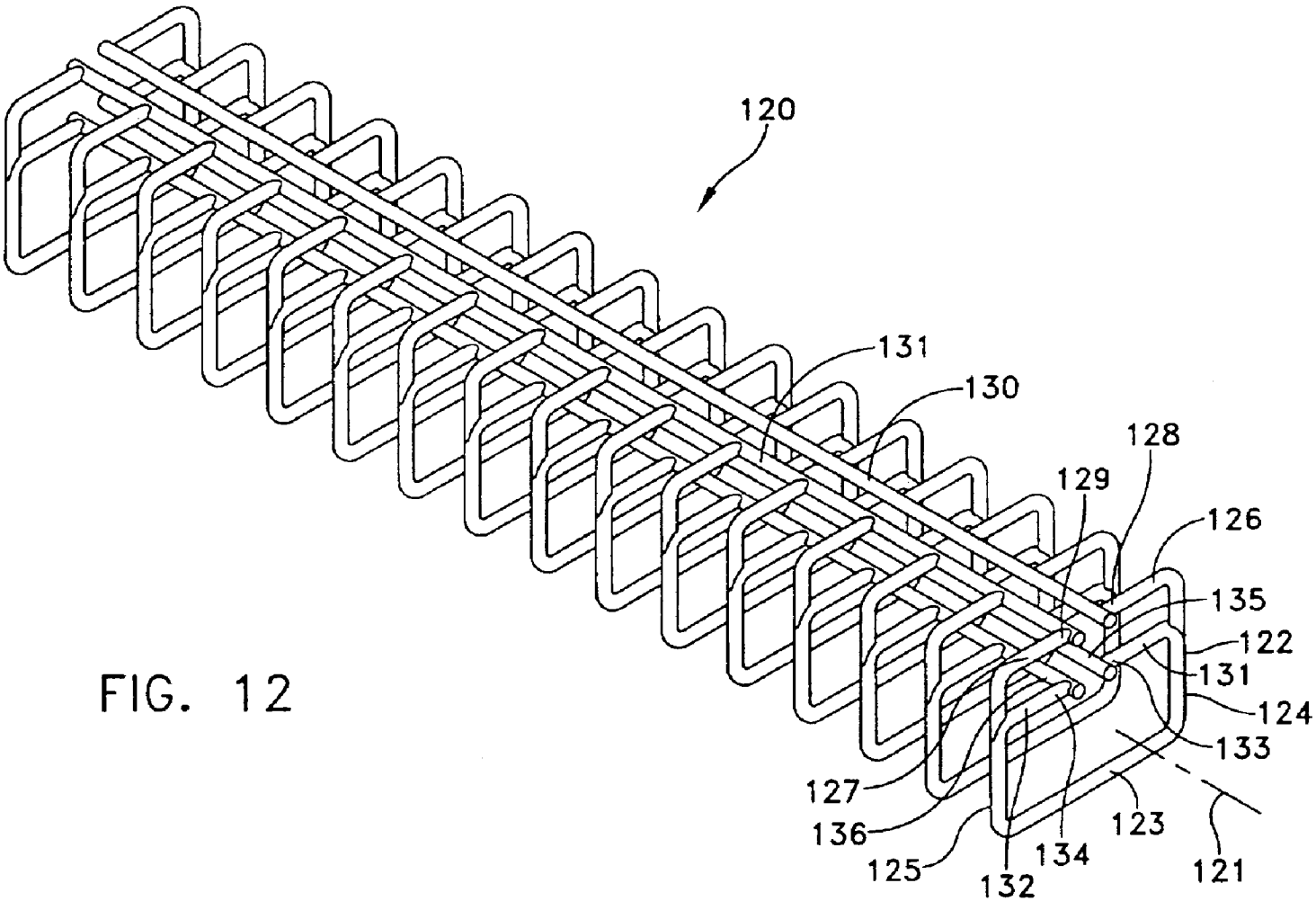

The antennas shown in FIGS. 1 and 7 through 11 each operate over a wide band. In some applications it may be desirable that the antenna operate over two wide bands that have widely separated center frequencies. FIG. 12 depicts a dual-band embodiment of an antenna 120 that extends along an axis 121. The antenna comprises a plurality of loops 122. In this particular embodiment, however, each loop 122 includes a bottom portion 123 and vertical portions 124 and 125 that extend to upper horizontal elements 126 and 127 respectively. The upper elements 126 and 127 terminate at facing and spaced first and second ends 128 and 129. Slot conductors 130 and 131 interconnect the loops at the ends corresponding to the upper first ends 128 and 129, respectively. This portion of each loop defines the lower of the operating frequency band. Horizontal elements 131 and 132 extend toward each other from vertical portions 124 and 125 to terminate at ends 133 and 134 respectively. Parallel conductors 135 and 136 interconnect elements ends 133 and 134 respectively. This defines a second loop orientation including the bottom leg 123, the horizontal legs 131 and 132 and the vertical legs 124 and 125 intermediate bottom leg 123, the horizontal legs 131 and 132. The operating characteristics of this second lobe define the upper operating frequency.

Still referring to FIG. 12, the lower frequency band connections are made to the conductors 130 and 131; the upper frequency connections, to the conductors 135 and 136. It has been found that the lower frequency slot produced by the conductors 131 and 132 is capacitively coupled to the edges of the higher frequency antenna. The degree of coupling can be adjusted by spacing for optimal performance. For example, such an antenna might be constructed to cover both the UHF and L frequency bands. Similar mechanical arrangements might stack or more slots to allow the structure to operate with three or more widely separated bands.

Figure 13:
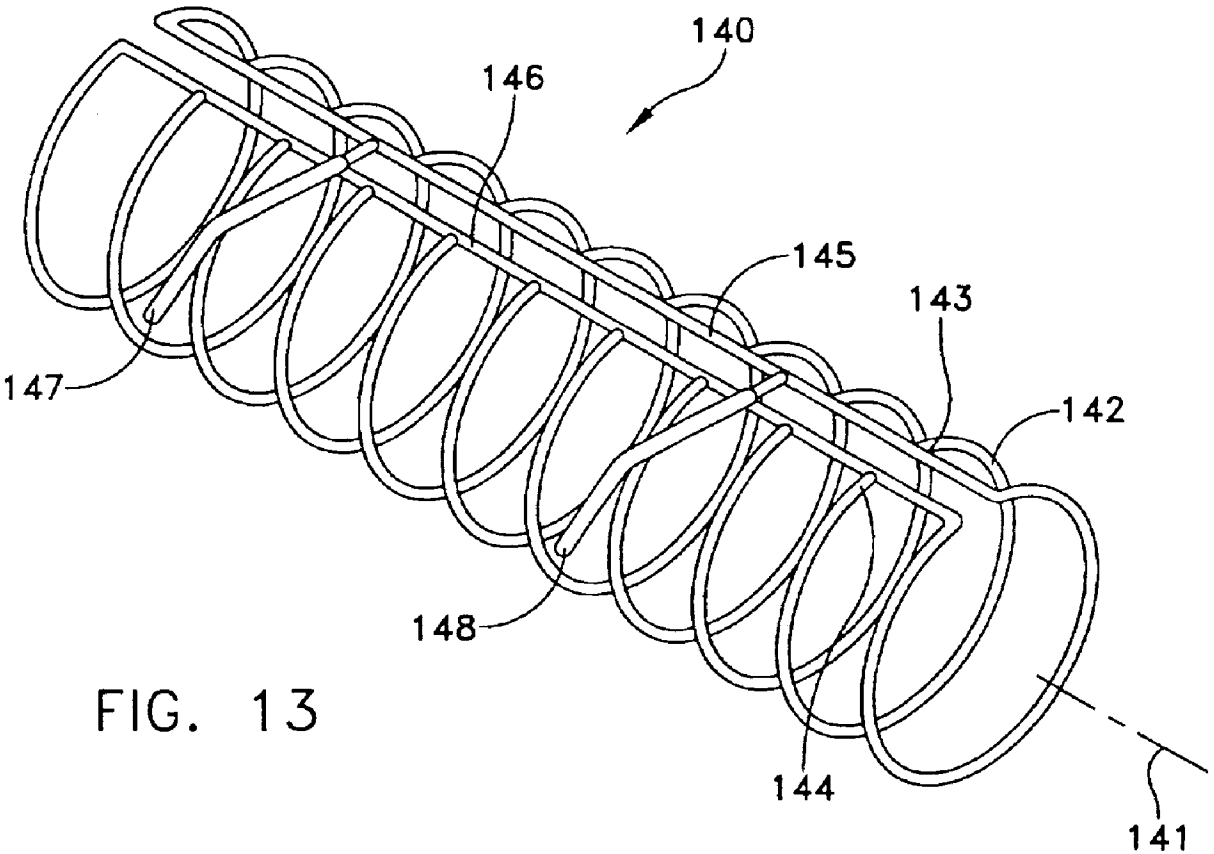

FIG. 13 depicts an alternative embodiment of an antenna 140 that is capable of shifting the radiation pattern between end-fire and broadside lobes. Like the other antennas, the antenna 140 lies along an antenna axis 141 and comprises a plurality of loops 142. Each of the loops has first and second spaced ends 143 and 144. A pair of spaced conductors 145 and 146 interconnect the first ends 143 and second ends 144 respectively to define a slot. This embodiment includes two feed points. The first feed point comprises a feed 147; the second, a feed 148. Adjusting the phase difference of the signal applied to the two feeds has the effect of either shifting the radiation pattern to two end-fire lobes (with a 180° phase shift) or a broad-side mode with a 0° phase shift. If the signal is applied with a 270° phase shift, one end fire lobe may be radiated.

Figure 14:
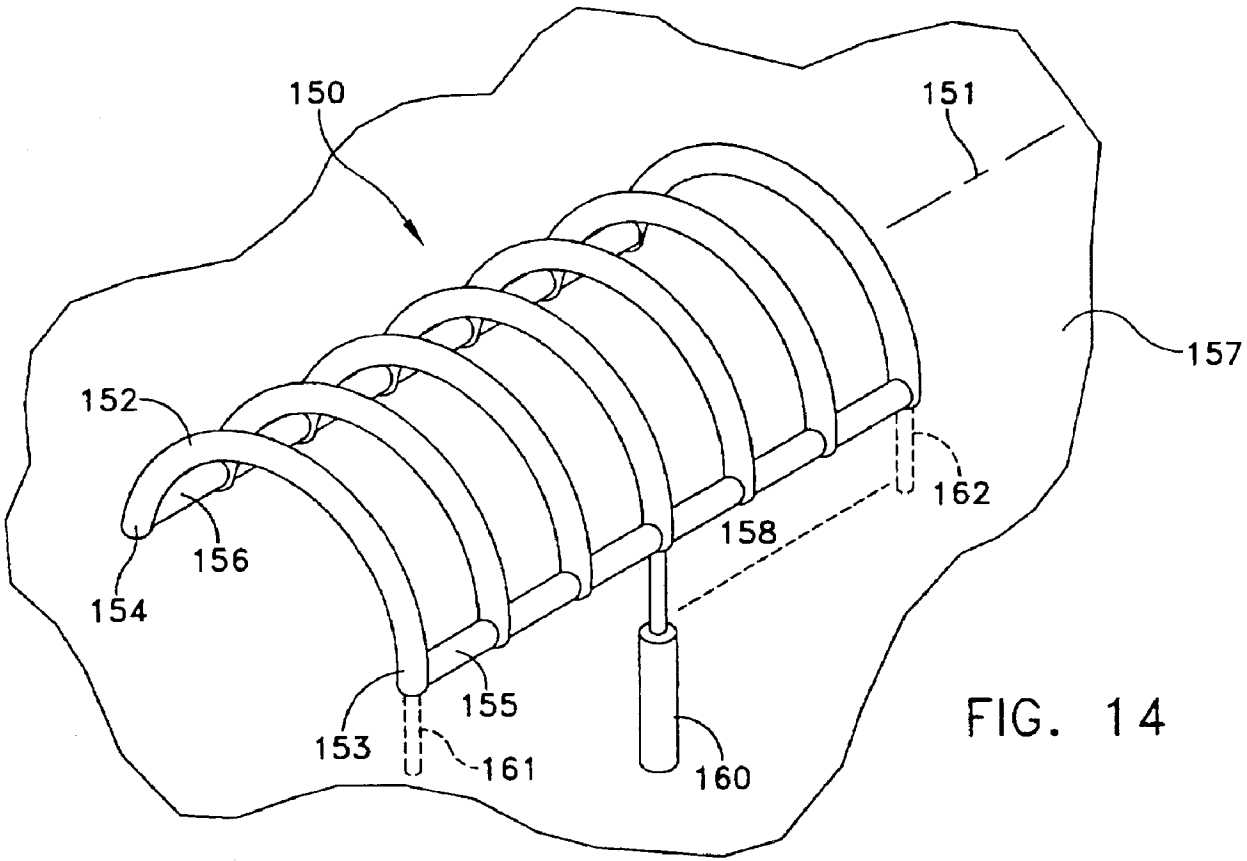
FIG. 14 depicts still another embodiment of an antenna structure that is useful in accordance with this invention.

FIG. 14 depicts still another embodiment of a slot antenna that is adapted for operating against a ground plane. This embodiment includes an antenna 150 that lies along an axis 151 and comprises a plurality of semi-circular loops 152. Each loop has a first end 153 and a second end 154. A conductive element 155 interconnects each of the first ends 153. Another conductive element 156 interconnects each of the second ends 154. The second conductor 156 and the second ends 154 connect to a ground plane 157. A center feed 160 attaches to drive the conductor 155. Such an antenna could be particularly useful in a car or on a surface ship. In addition, the antenna structure in 150 could have further modifications. For example, the structure could include spaced shorting pins at 161 and 162 as shown in phantom. Shorting pins could be placed at other arbitrary points to define different slot regions such as the slot region 158. Such shorting pin placements would-control pattern or impedance characteristics.

In summary, there has been disclosed a basic antenna structure of spaced loops that define a slot. The basic configuration is shown with a number of modifications, including square and circular loops, straight and meandering paths, loops that comprise multiple loop portions. Loop shapes and slot paths other than these specifically disclosed can be substituted. These antennas provide performance corresponding to a solid cylindrical slotted antenna. In addition, the configuration enables each antenna structure to be constructed on a flexible substrate such that the portions of the loop opposite from the slots can be bent toward each other thereby to provide a structure that is flexible. Moreover, as the antenna can be take the form of a structure such as shown in any of the FIGS. 1 and 7 through 12 and supported by a compressible material or can have a form that is deposited on a collapsible support such as shown on FIGS. 3 and 4.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An antenna comprising:

a support extending along an antenna axis being flexible about loci transverse to the axis, having conductive coatings, comprising an expansible member having a compact form and an expanded form; and a slotted antenna structure formed on the support having an axis coincident with the antenna axis and having a plurality of adjacent antenna loops extending along the antenna axis.

2. An antenna as recited in claim 1 further comprising a pair of conductors interconnecting said adjacent antenna loops and defining a slot of said slotted antenna structure.

3. An antenna as recited in claim 2 wherein said pair of conductors lie along a straight line.

4. An antenna as recited in claim 2 wherein said pair of conductors meanders along the antenna axis.

5. An antenna as recited in claim 1 wherein each antenna loop comprises:

an open loop with counterfacing first and second ends; and first and second spaced conductors interconnecting said first and second ends respectively thereby to define a slot.

6. An antenna as recited in claim 5 wherein said counterfacing first and second ends and said first and second conductors lie in straight lines.

7. An antenna as recited in claim 5 wherein said counterfacing first and second ends and said first and second conductors meander with respect to the antenna axis.

8. An antenna as recited in claim 7 wherein said counterfacing first and second ends and said first and second conductors meander circumferentially at a constant radius from the antenna axis.

9. An antenna as recited in claim 7 wherein said counterfacing first and second ends and said first and second conductors meander radially at axially displaced locations.

10. An antenna as recited in claim 5 wherein each of said antenna loops additionally comprises:

third and fourth ends counterfacing ends that are radially intermediate the antenna axis and the first and second ends; and third and fourth spaced conductors attached to said third and fourth conductor ends, respectively.

11. An antenna as recited in claim 1 further comprising an underwater housing having a drum for storing said antenna and wherein said antenna is flexible about the antenna axis to conform to the circumference of the drum when the antenna is stored thereon.

12. A wideband antenna for emulating the characteristics of a solid slot antenna comprising:

a plurality of conductive loops spaced along and substantially transverse to an antenna axis whereby said conductive loops are oriented in a substantially parallel relationship, each said conductive loop having first and second spaced, facing end portions that are aligned along a meandering path;

a first conductor interconnecting said conductive loop first end portions and extending along said meandering path; and a second conductor interconnecting said conductive loop second end portions and being spaced from said first conductor, whereby said first and second conductors define a slot path, and whereby said second conductor also extends along said meandering path.

13. An antenna as recited in claim 12 wherein said conductive loop first and second end portions are aligned linearly along the antenna axis and each of said first and second conductors extends along a straight path.

14. An antenna as recited in claim 12 wherein said conductive loops define an outer antenna edge and the path meanders radially, each of said first and second conductors having portions thereof proximate the antenna axis and other portions at the outer antenna edge.

15. An antenna as recited in claim 12 wherein said conductive loops define an outer antenna edge and the meandering path meanders circumferentially at the outer antenna edge, each of said first and second conductors having shapes that correspond to the meandering path.

16. An antenna as recited in claim 12 wherein each of said conductive loops additionally comprises:

third and fourth counterfacing end portions that are radially intermediate the antenna axis and the first and second ends; and third and fourth spaced conductors attached to said third and four conductor ends, respectively whereby said antenna is operable with a first frequency band determined by the conductive loops and said first and second conductors and with a second frequency band determined by the conductive loops and said third and fourth conductors.

17. An antenna as recited in claim 12 wherein each of said conductive loops has a semicircular shape and said first and second conductors attach to the first and second ends, said first conductor being grounded.

18. An antenna as recited in claim 17 further comprising at least one shorting pin attached to said second conductor, said shorting pins controlling one of pattern characteristics, impedance characteristics and a combination of pattern and impedance characteristics.

* * * * *